US005511664A

United States Patent [19]

Aramaki et al.

[11] Patent Number: 5,511,664

[45] Date of Patent: Apr. 30, 1996

[54] WRAPPED ARTICLE

[75] Inventors: Satoshi Aramaki, Tokyo; Makoto Sato, Kanagawa, both of Japan

[73] Assignee: Fuji Photo Film Co., Ltd., Kanagawa, Japan

[21] Appl. No.: 263,444

[22] Filed: Jun. 21, 1994

[30] Foreign Application Priority Data

Jun. 21, 1993 [JP] Japan ..... 5-033054 U

[51] Int. Cl.[6] ..... B65D 65/28; B65D 65/32

[52] U.S. Cl. ..... 206/525; 206/387.1; 206/497; 383/207

[58] Field of Search ..... 206/484, 525, 206/387.1, 497; 229/87.05, 314; 383/207–209

[56] References Cited

U.S. PATENT DOCUMENTS

| | | | |
|---|---|---|---|
| 3,179,327 | 4/1965 | Burton et al. | 383/209 |
| 3,379,364 | 4/1968 | Pilger | 229/87.05 |
| 3,641,732 | 2/1972 | Fujio | 229/87.05 |
| 4,158,412 | 6/1979 | Wysocki . | |
| 4,303,155 | 12/1981 | Focke et al. | 229/87.05 |
| 4,666,079 | 5/1987 | Bolli et al. | 229/87.05 |
| 4,726,473 | 2/1988 | Sato et al. . | |
| 4,836,378 | 6/1989 | Lephardt | 229/87.05 |
| 4,938,363 | 7/1990 | Amendola | 229/87.05 |
| 5,011,014 | 4/1991 | Borck et al. | 229/87.05 |
| 5,184,771 | 2/1993 | Jud et al. | 229/87.05 |

FOREIGN PATENT DOCUMENTS

| | | |
|---|---|---|
| 2123376 | 2/1984 | United Kingdom . |
| 2212471 | 7/1989 | United Kingdom . |

*Primary Examiner*—Jimmy G. Foster
*Attorney, Agent, or Firm*—Sughrue, Mion, Zinn, Macpeak & Seas

[57] ABSTRACT

The outer surface of an article is covered with a wrapping film, and both ends of the wrapping film are lap-welded by heating, so that a body seal section is created. A removal tab is created at a position close to the longitudinal end thereof by slits that are spaced apart from each other by a predetermined distance and cut parallel to each other along the marginal line of the body seal section on an upper overlapping film of the wrapping film. A perforated section is created and extended in line with one of the slits that constitute the removal tab in such a way that it crosses an imaginary continuation from this slit and departs from another imaginary continuation from the remaining slit. The end of the removal tab is picked up with fingers, and the fingers are moved in a direction of an arrow A, and the wrapping film is torn up from the slits. A split from one of the slits reaches the perforated section. Further pulling of the removal tab in the A direction causes the split from the slit to spread along the perforated section, and a split from another slit also spreads, whereby the wrapping film is widely opened.

13 Claims, 9 Drawing Sheets

WRAPPED ARTICLE

BACKGROUND OF THE INVENTION

1. Field of the Invention

This invention relates to an article wrapped with a wrapping film, and more particularly to a wrapped article in such a form that a wrapping film is attached in close contact with an object to be wrapped, for example, a wrapped article which contains one or a number of objects such as a magnetic tape cassette housed in a case.

2. Description of the Prior Art

Among various types of recent commodities arranged in a shop, in the case of relatively small products having a regular shape such as a magnetic tape cassette, the product is wrapped with a transparent or translucent wrapping film coated with cellophane, polyethylene, polypropylene, polyvinylchloride, polyvinylidenechloride, or the like, in order to protect the product from dust or moisture and so maintain a good appearance. These magnetic tape cassettes are shipped as a wrapped article or displayed in the shop as one of a number of packages to be sold en block in which an appropriate number of goods are collectively packed.

As a matter of course, when an article (a product) wrapped in this type of wrapping film is used, it is necessary to remove this wrapping film. In most cases, as shown in FIG. 19, a tearing tape 2 is formed inside the wrapping film, and a constitution for facilitating the removal of the film from an article 10 is generally adopted.

In other words, this tearing tape 2 allows a wrapping film 1 to be appropriately split and separated by pulling an exposed end 2*a* of the tape 2. Slits 3 are cut along this tearing tape in the vicinity of the exposed end 2*a*, thereby facilitating the removal of the tape. By means of such a constitution, the wrapping film 1 can be split along the tearing tape 2 from the end 2*a*. As a result of this, the wrapping film 1 is split up completely or separated in two.

A wrapping method which is generally called shrink-wrap is widely used for such a wrapping film. In this shrink-wrap, when a wrapping film is attached to an article to be wrapped (i.e. a product), the product is enclosed in the wrapping film while the film is appropriately stretched, or is heated to a suitable temperature, after the product has been wrapped, in accordance with the material of the film. The wrapping film is tightly attached on to the surface of the product because of a contracting action of the film, so that the product is enclosed giving it a good appearance. Such tight attachment of the film to the product involves a laborious removal action to open the film. Conventionally, several measures are taken to overcome the drawback in the prior art by, for example, forming the tearing tape as mentioned above. This tearing tape was a very effective means.

However, in order to create a tearing tape inside a wrapping film, machines and processes which are dedicated to produce the tearing tape become necessary. In addition, in view of its function, the tearing tape must be sturdier than the wrapping film, and this tearing tape adds to the cost.

Moreover, although it depends on the position of the tearing tape, when the tearing tape is disposed as shown in FIG. 19, a smaller part "a" of the film remaining after the film has been split by the tearing tape is easy to remove. On the other hand, a larger remaining film "b" involves a very laborious removal action in order to get at the actual content.

SUMMARY OF THE INVENTION

In view of the foregoing observations, the primary object of this invention is to provide a wrapped article which requires neither special machines nor members; and which enables easy removal of a wrapping film and easy access to an article enclosed in the wrapping film by widely tearing off the wrapping when the film is opened.

To this end, according to a first aspect of the present invention, there is provided a wrapped article including an article to be wrapped whose outer surface is covered with a wrapping film and a body seal section created by making ends of the wrapping film overlap with each other and bonding them together, the improvement comprising:

a removal tab portion made up of two slits that are spaced apart from each other by a given interval and cut along the edge of the body seal section of an upper wrapping film of the wrapping film in the body seal section; and at least one perforated section or indentation which starts from a point at which the perforated section or indentation and an imaginary continuation from at least one of the two slits of the removal tab cross, and which extends in a direction moving away from the imaginary continuation of the other slit.

Also, according to a second aspect of this invention, there is provided a wrapped article including an article to be wrapped whose outer surface is covered with a wrapping film and a body seal section created by making ends of the wrapping film overlap with each other and bonding them together, the improvement comprising:

a removal tab portion made up of two slits that are spaced apart from each other by a given interval and cut along the edge of the body seal section of an upper wrapping film of the wrapping film in the body seal section; and at least one first perforated section or indentation which starts from a point at which the perforated section or indentation and an imaginary continuation from at least one of the two slits of the removal tab cross, and which extends in a direction moving away from the imaginary continuation of the other slit; and at least one second perforated section or indentation which starts from a point at which the second perforated section or indentation and the imaginary continuation from the other slit cross, and which extends in a direction moving away from the first perforated section or indentation.

According to a third aspect of this invention, there is provided a wrapped article including an article to be wrapped whose outer surface is covered with a wrapping film and a body seal section created by making ends of the wrapping film overlap with each other and bonding them together, the improvement comprising:

a removal tab portion made up of two slits that are spaced apart from each other by a given interval and cut along the edge of the body seal section of an upper wrapping film of the wrapping film in the body seal section; and at least one first perforated section or indentation which starts from a point at which the perforated section or indentation and an imaginary continuation from at least one of the two slits of the removal tab cross, and which extends in a direction moving away from the imaginary continuation of the other slit; and at least one second perforated section or indentation which starts from a point at which the second perforated section or indentation and the imaginary continuation from the other slit cross, and which extends parallel to the first perforated section or indentation.

Here, the expression "a point at which the perforated section or indentation and an imaginary continuation cross" used herein implies not only the state in which the perforated section or indentation crosses the imaginary continuation but also the state in which the perforated section or indentation lies in line with the imaginary continuation.

In one preferred mode, the front surface or the back surface of the removal tab is printed in ink that is different from the wrapping film in coefficient of thermal contraction.

In another preferred mode, the removal tab may be provided with a mark that makes the removal tab distinctive and indicates a peeling direction.

In such a wrapped article, the removal tab consisting of the two slits is held with fingers or picked up with a fingernail, or the like. The removal tab thus picked up is then pulled in a direction which is substantially orthogonal to the body seal section, and hence the wrapping film is peeled off from the removal tab and is torn up along the imaginary continuation from one of the slits. A split developing from one of the slits reaches the foregoing perforated section or indentation, and stretches along this perforated section or indentation. This perforated section or indentation is formed in such a fashion that it moves away from the imaginary continuation from the other slit, and hence the perforated section or indentation from the removal tab largely spreads. This causes the wrapping film to be widely opened, and hence it becomes very easy for a user to remove the film so that the entire wrapped article can be substantially uncovered.

The second perforated section or indentation is formed in line with the imaginary continuation from the other slit, and hence the split from the removal tab spreads much wider, whereby the wrapping film can be removed more easily.

The front or rear surface of the removal tab is printed in ink that differs from the wrapping film in thermal coefficient of contraction. Hence, when the wrapping film is heated by shrink-wrapping, the removal tab is warped concavely or convexly with respect to the front or rear surface of the wrapping film because of a difference in coefficient of thermal contraction. For this reason, the removal tab becomes much easier to pick up, and the split from the removal tab is given the linearly advancing characteristic, whereby the wrapping film can be removed more easily.

Moreover, the removal tab should preferably be provided with a mark to make clear the position of the removal tab and a peeling direction, and hence the position from which the wrapping film is removed becomes clear.

DESCRIPTION OF THE PREFERRED EMBODIMENTS

With reference to the accompanying drawings, preferred embodiments of the present invention will now be described.

Figure 1:
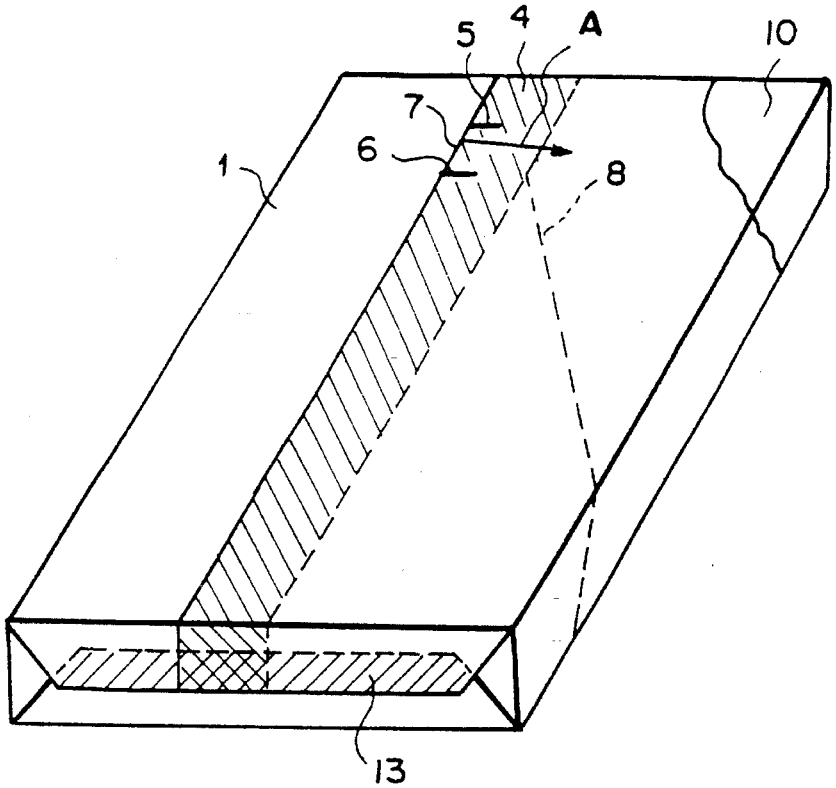
FIG. 1 is schematic representation of a wrapped article according to a first embodiment of this invention.

First Embodiment:

FIG. 1 is a schematic representation showing a wrapped article according to a first embodiment of the present invention in which a video cassette is to be wrapped.

As shown in FIG. 1, side edges of a wrapping film 1 overlap with each other at substantially the center of a wider surface of a rectangular parallelopiped article to be wrapped 10 which is a video cassette (when it is encased in a housing case), and heated and welded together to constitute a body seal section 4 (this body seal section will be herein designated by a slanting line). Both ends of the body seal section 4 are welded together with the other sides of the film so as to reach a side seal section 13.

The body seal section 4 and the side seal section 13 where both ends of the wrapping film 1 overlap with each other are welded by appropriate heating after the article to be wrapped 10 has been wrapped.

A removal tab 7 is made at a position close to the longitudinal end of the body seal section 4 along its marginal line in an upper overlapping film of the wrapping film 1. This removal tab is formed by the combination of slits 5 and 6 which are cut at right angles to the marginal line in the upper overlapping film in such a way that they are spaced apart from each other by a given interval and parallel to each other. A perforated section 8 is formed in such a way that it crosses an imaginary continuation from the slit 6 of the removal tab 7 and extends away from the imaginary continuation from the slit 5.

The way the wrapped article of the present invention is peeled off will now be described.

Figure 2:
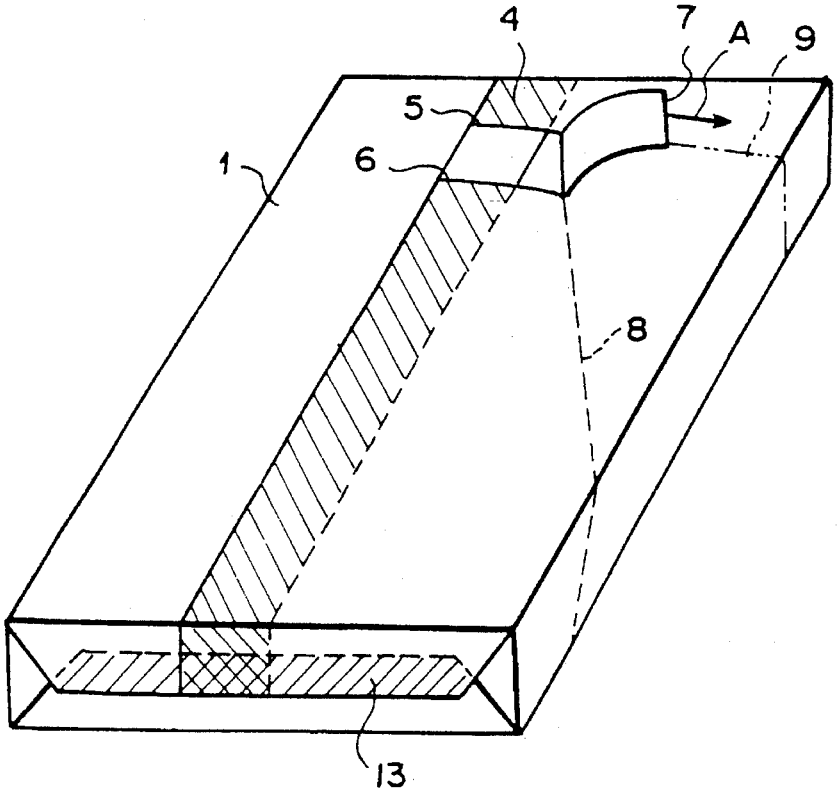
FIG. 2 is a schematic representation of the wrapped article shown in FIG. 1 when a removal tab is lifted.

Initially, the end of the removal tab 7 is held with fingers or picked up with a fingernail or the like, and the fingers are moved in the direction of an arrow A as shown in FIG. 1. Thereby, as shown in FIG. 2, the overlapping film 1 is peeled from the slits 5 and 6; the removal tab 7 is lifted off from the lower overlapping film; and the split from the slit 6 reaches the perforated section 8.

Figure 3:
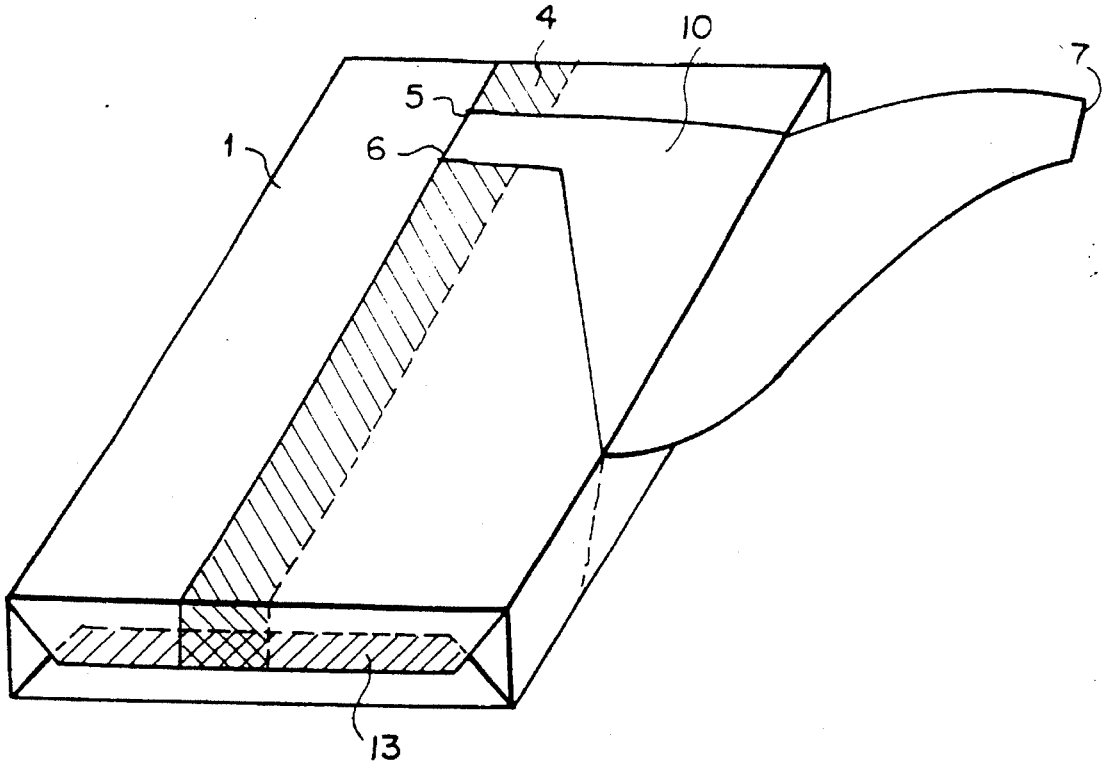
FIG. 3 is a schematic representation of the wrapped article shown in FIG. 1 when the removal tab is pulled further.

Further pulling of the removal tab 7 in a direction of an arrow A causes a split from the slit 6 to spread along the perforated section 8, and causes another split from the slit 5 to spread along an imaginary line 9. Thereby, as shown in FIG. 3, the wrapping film 1 is opened more widely.

The split formed by such tearing actions makes it possible to cause tearing actions in such a way that the split will continue around the wrapping film 1 by pulling the removal tab 7 formed in the upper overlapping film and tearing the film. Thereby, the wrapping film 1 is opened more widely, and hence the film 1 can be peeled off in such a way that substantially the whole wrapped article 10 is extremely easily uncovered.

The removal tab 7 is created in the vicinity of the surface on which the side seal section 13 of the wrapped article 10 is formed. Therefore, a part of the wrapping film 1 remaining on the surface on which the side seal section 13 is formed can be extremely easily taken off by pulling the remaining wrapping film in the direction in which it is removed.

In a conventional wrapped article, when the wrapping film is separated into two by a tearing tape, it is relatively difficult for a user to take off that one of the two subdivisions which is left in a direction opposite to the direction of the tearing of the wrapping film. Compared with this, the wrapped article of this invention allows an extremely effective removal operation by a single action, and eliminates the necessity of using the tearing tape, thereby rendering this wrapped article very cost effective.

Figure 4:
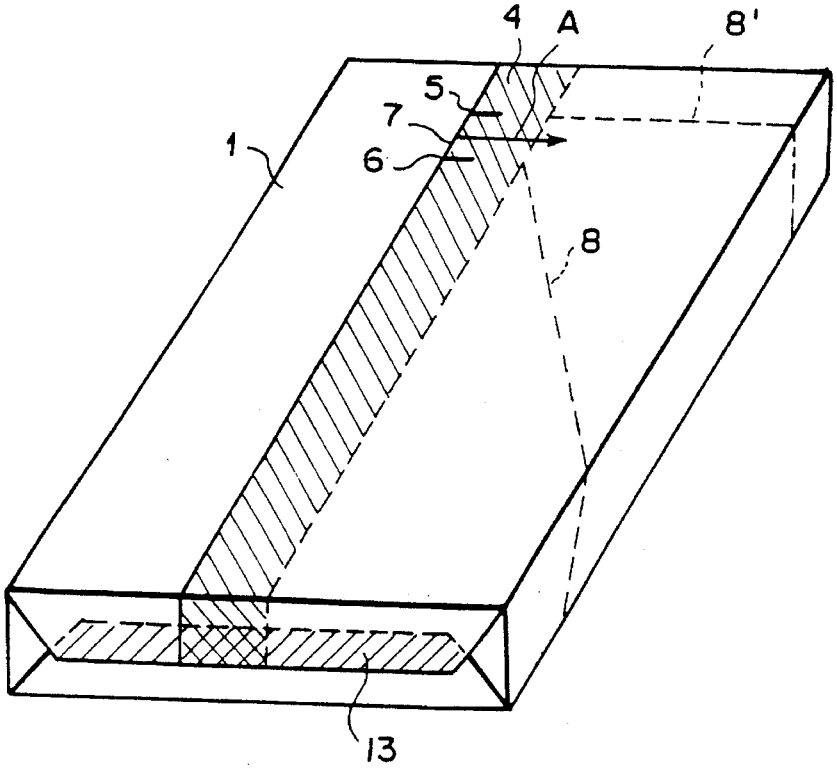
FIG. 4 is a schematic representation of a wrapped article according to a second embodiment of this invention.

Second Embodiment:

A wrapped article according to a second embodiment of the present invention will now be described. FIG. 4 shows a wrapped article of this embodiment. In FIG. 4, a wrapped state of the wrapping film 1, the slits 5 and 6, the removal tab 7 and the perforated section 8 are the same as those of the first embodiment, and hence the detailed explanation thereof will be omitted here for brevity.

In this embodiment, a second perforated section 8' is created in line with an imaginary continuation from the slit 5.

In the same manner as in the first embodiment, the removal tab 7 is initially held with fingers or picked up with a fingernail or the like, and the fingers are moved to the A direction as shown in FIG. 4. In the same manner as in the first embodiment, this causes the wrapping film 1 to be torn up from the slits 5 and 6 that constitute the removal tab 7, and the removal tab 7 is lifted off from the lower overlapping film, so that the split from the slit 6 reaches the perforated section 8. Together with this, the split from the slit 5 reaches the perforated section 8'.

Further pulling of the removal tab 7 in the A direction causes the split from the slit 6 to spread along the perforated section 8, and causes the split from the slit 5 to spread along the perforated section 8'. Thereby, in the same manner as in the first embodiment, the wrapping film 1 is opened more widely.

Thus, the creation of the second perforated section 8' in line with the slit 5 facilitates the opening of the wrapping film 1 to a much greater extent.

Figure 5:
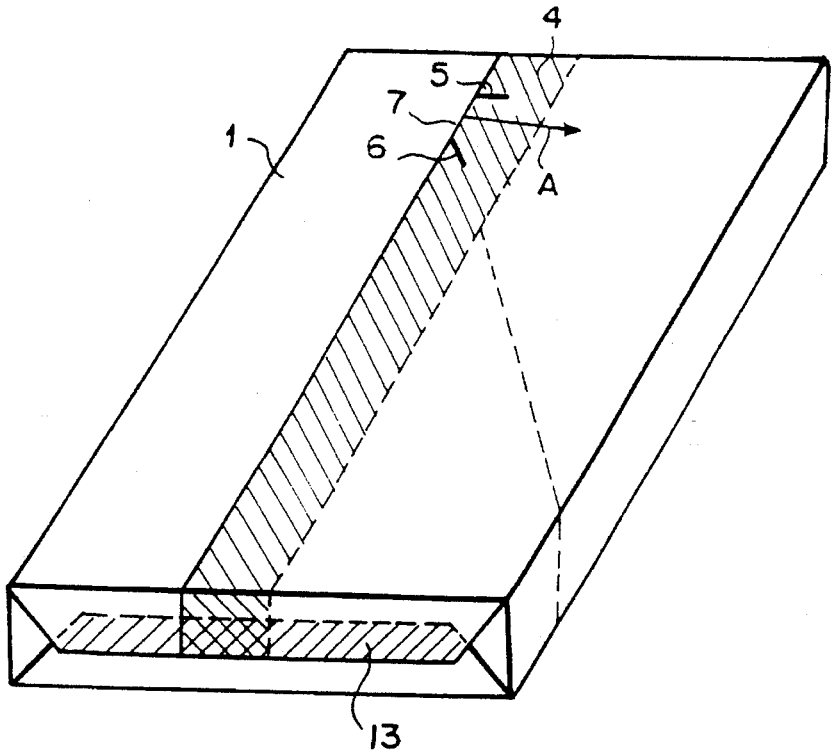
FIG. 5 is a schematic representation of a wrapped article according to a third embodiment of this invention.

Third Embodiment:

A wrapped article according to a third embodiment of the present invention will now be described. FIG. 5 shows the wrapped article of this embodiment.

In FIG. 5, a wrapped state of the wrapping film 1, the slits 5 and 6 and the removal tab 7 are the same as those in the first embodiment, and therefore the detailed explanation thereof will be omitted here for brevity. In the third embodiment as illustrated in FIG. 5, the removal tab 7 is created at a position close to the longitudinal end of the body seal section 4 along its marginal line in the upper overlapping film of the wrapping film 1. This removal tab 7 is made by the combination of the slits 5 and 6 which are cut at such an angle that they depart from each other by a given distance. Specifically, the slit 5 is cut substantially at right angles to the marginal line of the upper overlapping film. On the other hand, the slit 6 is cut at an angle relative to the marginal line of the upper overlapping film in such a way that an imaginary continuation from the slit 5 and an imaginary continuation from the slit 6 depart from each other. The perforated section 8 is formed in line with the imaginary continuation from the slit 6 that constitutes the removal tab 7.

As with the first and second embodiments, the end of the removal tab 7 is first held with fingers or picked up with a fingernail or the like, and the fingers are moved in the A direction as shown in FIG. 5. Thereby, in the same manner as in the first and second embodiments, the wrapping film 1 is torn up from the slits 5 and 6 that constitute the removal tab 7, and the removal tab 7 is lifted off from the lower overlapping film. Thus, the split from the slit 6 reaches the perforated section 8.

Figure 6:
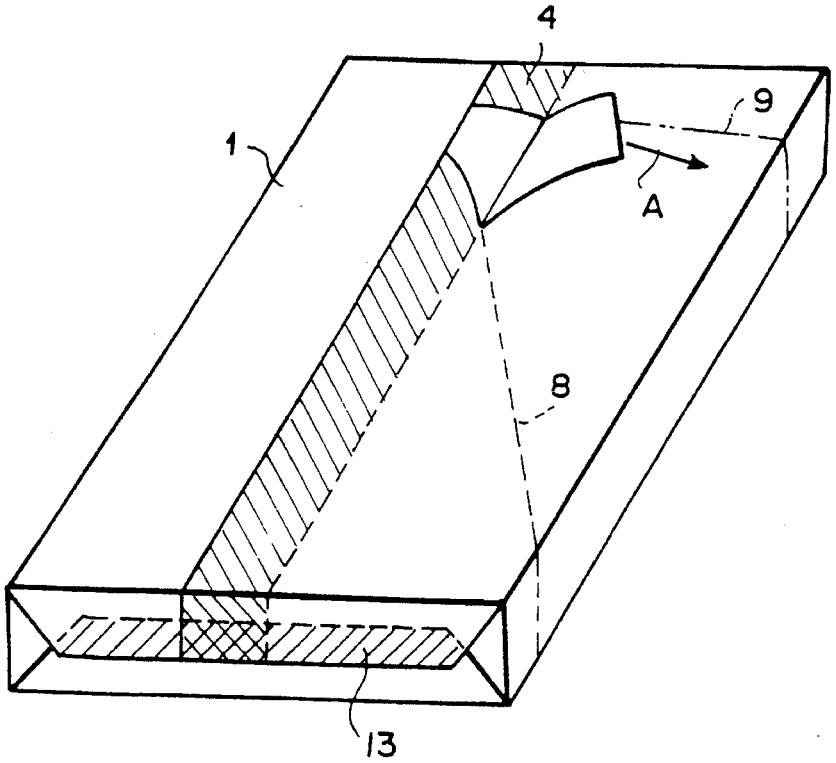
FIG. 6 is a schematic representation of the wrapped article shown in FIG. 5 when a removal tab is raised.

Further pulling of the removal tab 7 in the A direction causes the split from the slit 6 to spread along the perforated section 8 as shown in FIG. 6, and causes the split from the slit 5 to spread along the imaginary line 9. Thereby, in the same manner as in the first and second embodiments, the wrapping film 1 is opened more widely.

Like this, the slits 5 and 6 are created in such a way that the imaginary continuation from the slit 5 and the imaginary continuation from the slit 6 depart from each other, and hence the split from the removal tab 7 is torn up so as to widely extend while the split from the slit 6 reaches the perforated section 8. This makes it possible to facilitate the opening of the wrapping film 1.

Figure 7:
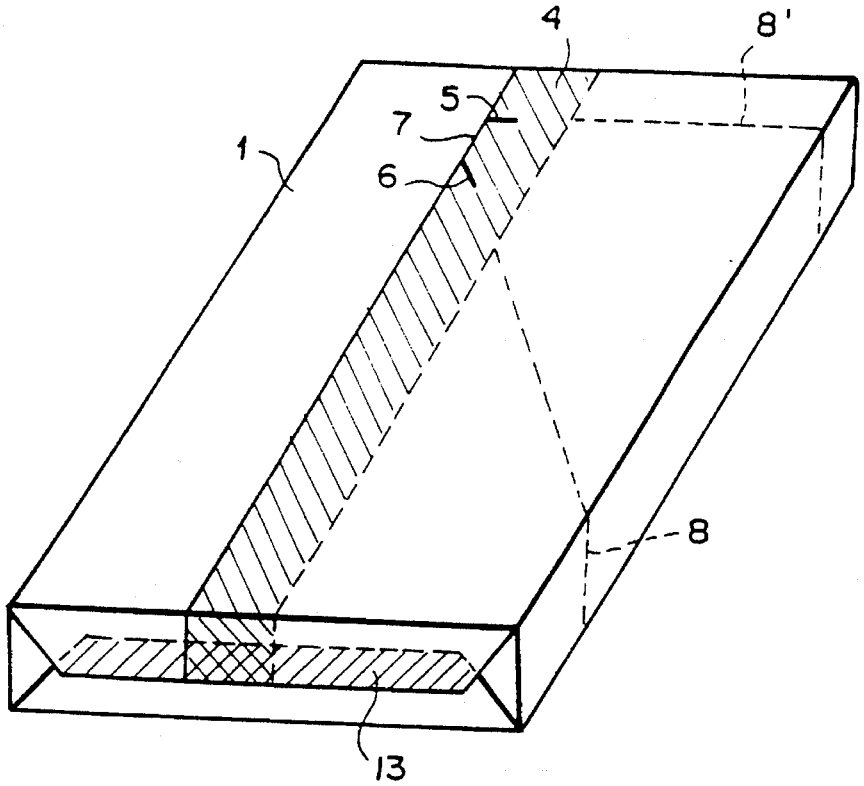
FIG. 7 is a schematic representation of a wrapped article according to a fourth embodiment of this invention.

Fourth Embodiment:

FIG. 7 shows a wrapped article according to a fourth embodiment of the present invention. As shown in FIG. 7, another perforated section 8' may be created in line with the slit 5 in the third embodiment in the same manner as in the second embodiment. Like this, the creation of the perforated section 8' allows the wrapping film 1 to be removed more easily in the same manner as in the second embodiment.

Fifth Embodiment

Figure 8:
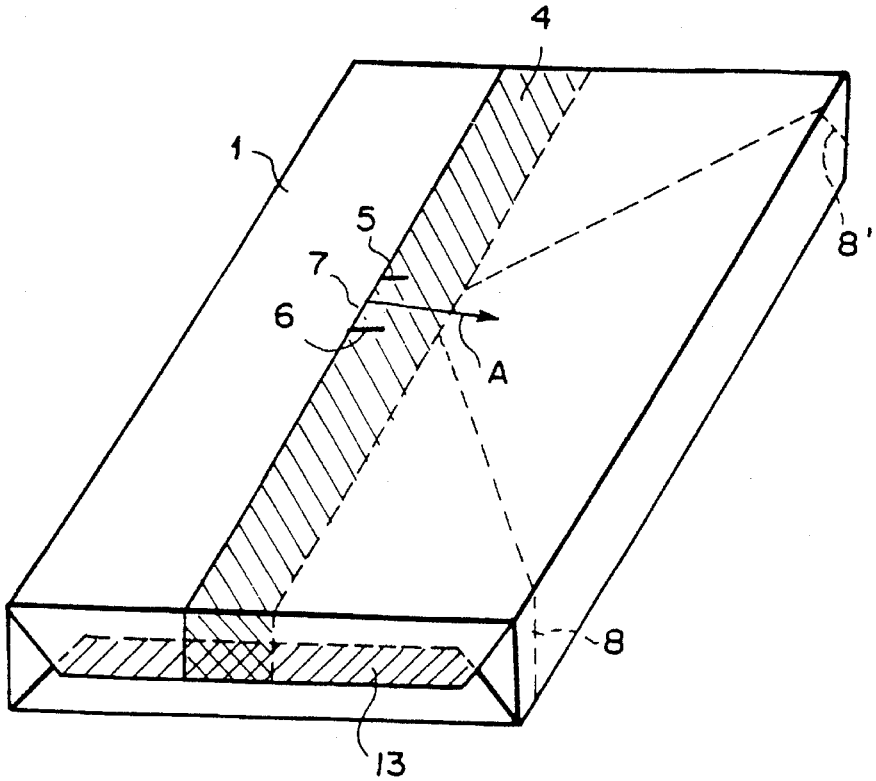
FIG. 8 is a schematic representation of a wrapped article according to a fifth embodiment of this invention.

FIG. 8 illustrates a wrapped article according to a fifth embodiment of the present invention. In FIG. 8, a wrapped state of the wrapping film 1 is the same as that in the first to fourth embodiments, and hence the detailed explanation thereof will be omitted here for brevity. In a fifth embodiment as shown in FIG. 8, the removal tab 7 is created substantially at the center of the body seal section 4 in a longitudinal direction thereof by the slits 5 and 6 that are spaced apart from each other by a predetermined distance and cut parallel to each other along the marginal line of the body seal section 4 of the upper overlapping film of the wrapping film 1. Each slitting direction of the slits 5 and 6 is at right angles to the marginal line of the body seal section 4 of the upper overlapping film. Perforated sections 8 and 8' are respectively formed on imaginary continuations from the slits 5 and 6 that constitute the removal tab 7.

The way the wrapped article of this embodiment is peeled off will now be described.

Initially, in the same manner as in the first to fourth embodiments, the end of the removal tab 7 is held with fingers or picked up with a fingernail or the like, and the fingers are moved to the direction A shown in FIG. 8. This causes the wrapping film 1 to be split from the slits 5 and 6 that constitute the removal tab 7 in the same manner as in the first to fourth embodiments, and hence the removal tab 7 is lifted off from the lower overlapping film, so that the splits from the slits 5 and 6 reach the perforated sections 8 and 8', respectively.

Figure 9:
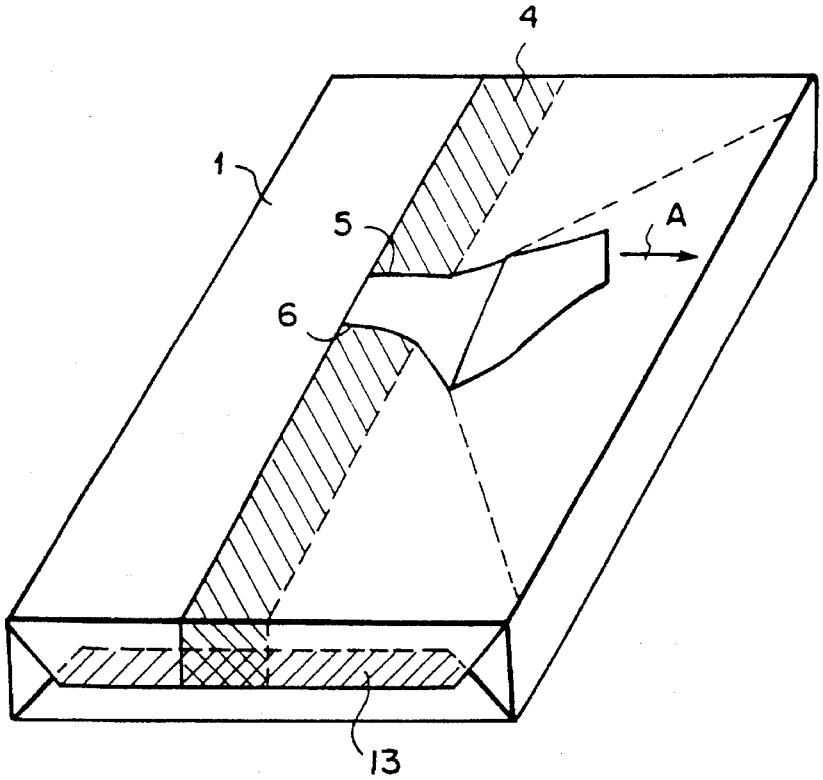
FIG. 9 is a schematic representation of the wrapped article shown in FIG. 8 when a removal tab is raised.

Further pulling of the removal tab 7 in the A direction causes the split from the slit 6 to spread along the perforated section 8 and the split from the slit 5 to spread along the perforated section 8' as shown in FIG. 9.

The split caused by such a tearing action can continue around the wrapping film 1 by pulling the removal tab 7 created in the upper overlapping film of the wrapping film 1, whereby the wrapping film is torn up more widely. Thus, the wrapping film 1 can be peeled off in such a way that substantially the entire wrapped article 10 is extremely easily uncovered.

Also, the perforated sections 8 and 8' are extended to the vicinity of the surfaces on which the side seal sections 13 of the wrapped article are created, and hence a part of the wrapping film 1 remaining on the surfaces on which the side seal sections 13 are created can be extremely easily removed by pulling that remaining part of the wrapping film 1 in the direction in which it is taken off.

Sixth Embodiment

Figure 10:
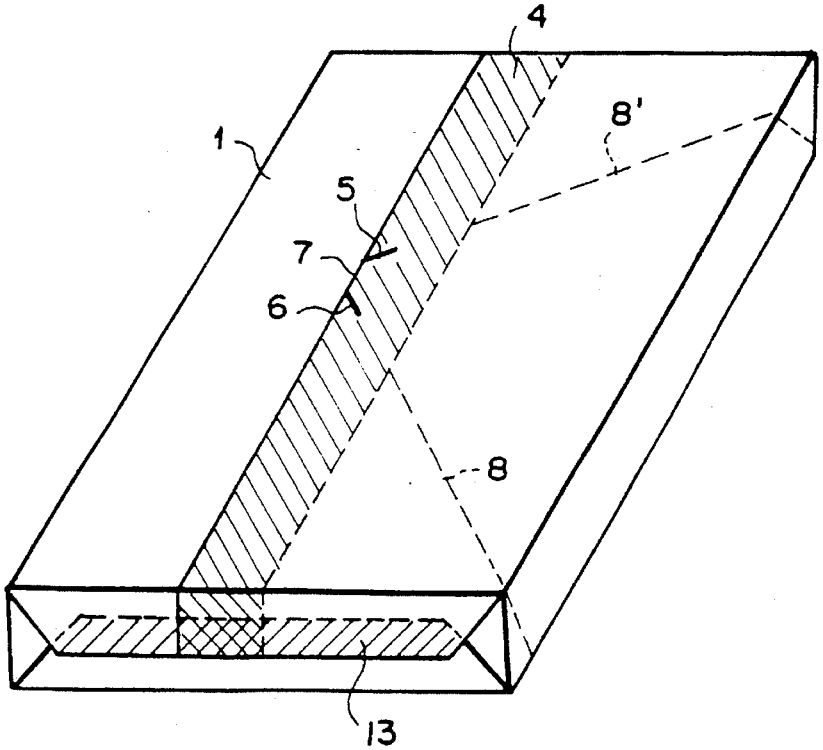
FIG. 10 is a schematic representation of a wrapped article according to a sixth embodiment of this invention.

FIG. 10 shows a wrapped article according to a sixth embodiment of the present invention.

In FIG. 10, a wrapped state of the wrapping film 1 is the same that in the first embodiment, and hence the detailed explanation thereof will be omitted here for brevity. In the sixth embodiment as shown in FIG. 10, the removal tab 7 is created substantially at the center of the body seal section 4 in the longitudinal direction thereof by the slits 5 and 6 that are spaced apart from each other by a predetermined distance and cut along the marginal line of the body seal section 4 on the upper overlapping film of the wrapping film 1 at such inclined angles that they depart from each other. Specifically, the slits 5 and 6 are created at some inclined angles with respect to the peripheral portion of the upper overlapping film in such a way that an imaginary continuation from the slit 5 and an imaginary continuation from the slit 6 depart from each other. In addition, the perforated sections 8 and 8' are created in line with the slits 5 and 6.

Initially, in the same manner as in the first to fifth embodiments, the end of the removal tab 7 is held with fingers or picked up with a fingernail or the like, and the fingers are moved to the direction A shown in FIG. 10. This causes the wrapping film 1 to be split from the slits 5 and 6 that constitute the removal tab 7 in the same manner as in the first to fifth embodiments, and hence the removal tab 7 is lifted off from the lower overlapping film, so that the splits from the slits 5 and 6 reach the perforated sections 8 and 8', respectively.

Further pulling of the removal tab 7 in the A direction causes the split from the slit 6 to spread along the perforated section 8 and the split from the slit 5 to spread along the perforated section 8'.

Thus, the slits 5 and 6 are created in such a way that an imaginary continuation from the slit 5 and an imaginary continuation from the slit 6 depart from each other. Hence, while the split from the slit 6 is reaching the perforated section 8, the split from the removal tab 7 is torn up so as to spread widely, thereby facilitating the opening of the wrapping film 1 to a greater extent.

Also, the perforated sections 8 and 8' are extended to the vicinity of the surfaces on which the side seal sections 13 of the wrapped article are created, and hence a part of the wrapping film 1 remaining on the surfaces on which the side seal sections 13 are created can be extremely easily removed by pulling that remaining part of the wrapping film 1 in the direction in which it is taken off.

Seventh Embodiment

Figure 11:
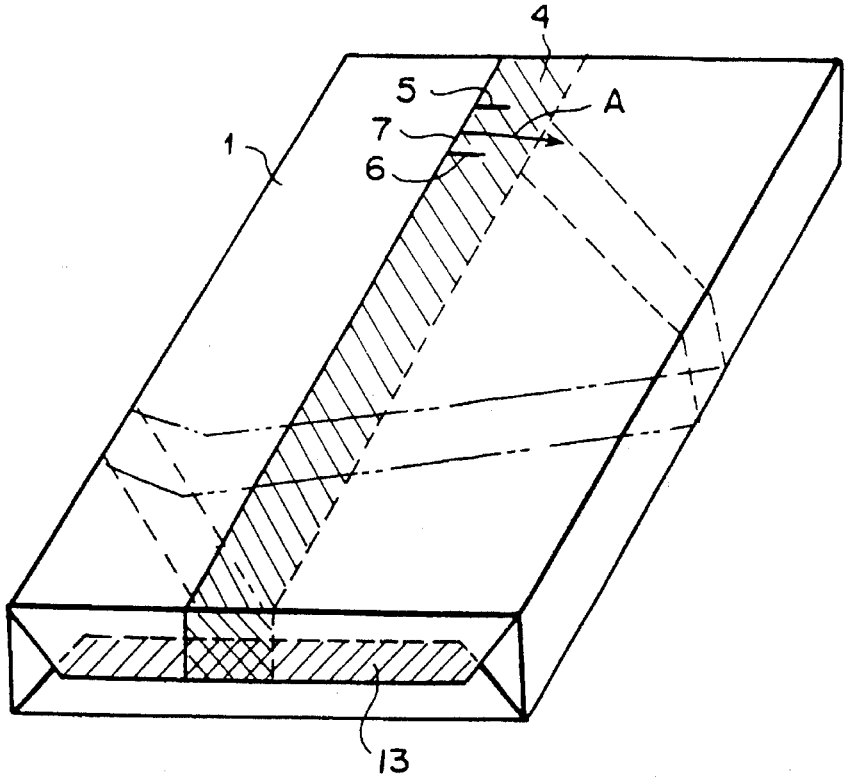
FIG. 11 is a schematic representation of a wrapped article according to a seventh embodiment of this invention.

FIG. 11 shows a wrapped article according to a seventh embodiment of the present invention.

In FIG. 11, a wrapped state of the wrapping film 1 is the same as that in the first embodiment, and hence the detailed explanation thereof will be omitted here for brevity. In the seventh embodiment as shown in FIG. 11, the removal tab 7 is created at a position close to the longitudinal end of the body seal section 4 by the slits 5 and 6 that are spaced apart from each other by a predetermined distance and cut parallel to each other along the marginal line of the body seal section 4 on the upper overlapping film of the wrapping film 1. Moreover, the perforated sections 8 and 8' which are parallel to each other are created so as to cross the imaginary continuations from the slits 5 and 6 that constitute the removal tab 7, and are extended so as to spirally continue around the wrapped article 10.

Initially, in the same manner as in the first to sixth embodiments, the end of the removal tab 7 is held with fingers or picked up with a fingernail or the like, and the fingers are moved to the direction A shown in FIG. 11. This causes the wrapping film 1 to be split from the slits 5 and 6 that constitute the removal tab 7 in the same manner as in the first to sixth embodiments, and hence the removal tab 7 is lifted off from the lower overlapping film, so that the splits from the slits 5 and 6 reach the perforated sections 8 and 8', respectively.

Figure 12:
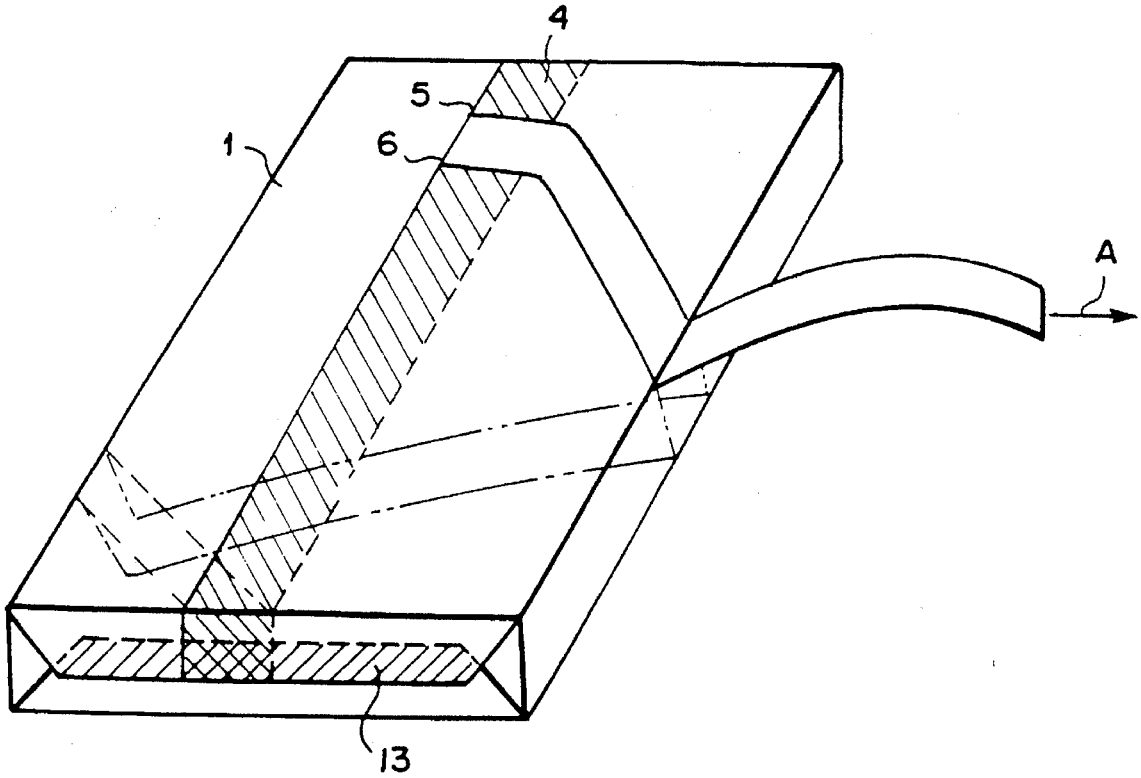
FIG. 12 is a schematic representation of the wrapped article shown in FIG. 11 when a removal tab is raised.

Further pulling of the removal tab 7 in the A direction causes the split from the slit 6 to spread along the perforated section 8 and the split from the slit 5 to spread along the perforated section 8' as shown in FIG. 12. This causes the split from the removal tab 7 to be torn up like a strip so as to continue around the wrapped article 10, and the wrapping film 1 is opened more widely in the same manner as in the first to sixth embodiments.

Also, the perforated sections 8 and 8' are extended to the vicinity of the surfaces on which the side seal sections 13 of the wrapped article are created, and hence a part of the wrapping film 1 remaining on the surfaces on which the side seal sections 13 are created can be extremely easily removed by pulling that remaining part of the wrapping film 1 in the direction in which it is taken off.

Like this, even in the case of the seventh embodiment, the wrapped article of this invention allows an extremely effective removal operation by a single action, and eliminates the necessity of using the tearing tape, thereby rendering this wrapped article very cost effective.

Figure 13:
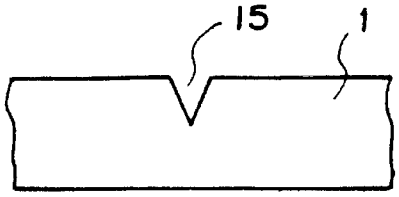
FIG. 13 is a cross-sectional view of an indentation.

In the foregoing embodiments, the perforated section is created at a position where it crosses the imaginary continuation from the slit for facilitating the opening of the wrapping film. However, the indentation may be created at the same location where the perforated section is created. For example, like the cross-sectional view of the wrapping film as shown in FIG. 13, an indentation 15 having a depth which is about half the thickness of the wrapping film 1 is created at the position where the aforementioned perforated section is created. This makes it possible for a user to remove the wrapping film as easily as in the case where the perforated section is created.

Figure 14A:
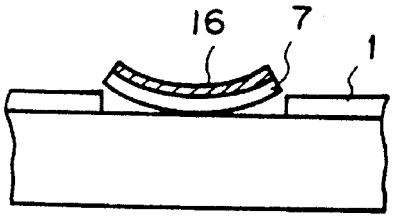
FIG. 14*a* and 14*b* are schematic representations showing a removal tab when it is concavely or convexly warped.
Figure 14B:
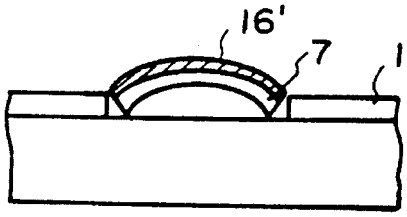
Figure 15:
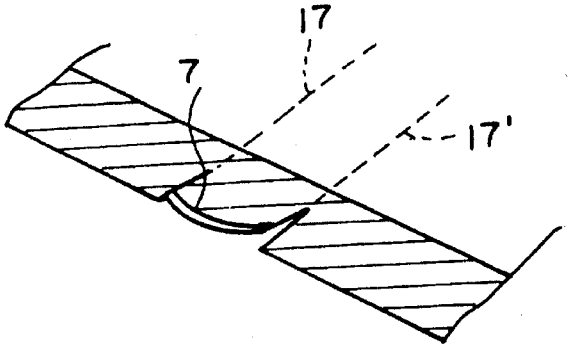
FIG. 15 is a schematic representation showing a removal tab when it is concavely warped.

In the previous embodiments, the front or rear surface between the two slits may be printed in ink that differs in coefficient of thermal contraction from the wrapping film. For instance, as shown in FIG. 14*a*, the removal tab 7 is printed in ink 16 having a coefficient of thermal contraction which is larger than that of the wrapping film 1. When an article is shrink-wrapped with the use of this wrapping film and then heated, the removal tab 7 becomes concave relative to the surface of the wrapping film 1. On the other hand, as shown in FIG. 14*b*, the removal tab 7 is printed in ink 16' having a coefficient of thermal contraction which is smaller than that of the wrapping film 1. When an article is shrink-wrapped with the use of this wrapping film and then heated, the removal tab 7 becomes convex relative to the surface of the wrapping film 1. Like this, printing the removal tab 7 in ink that differs in coefficient of thermal contraction from the wrapping film 1 makes the removal tab 7 easy to pick up. Also, as shown in FIG. 15, a split from the removal tab 7 is given linear advancing characteristics in such a way that it goes along imaginary lines 17 and 17', and hence the wrapping film 1 becomes more easily removable.

Figure 16:
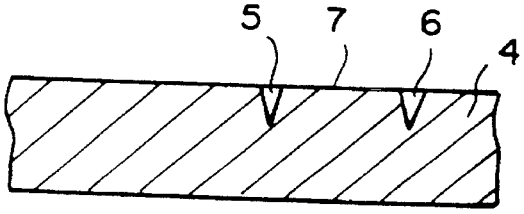
FIG. 16 is a schematic representation showing another embodiment of slits formed on the wrapped article of the present invention.

In the previous embodiments, the slits are linear in shape, but the slits 5 and 6 may be V-shaped as shown in FIG. 16, thereby making the slits 5 and 6 more easy to pick up.

Figure 17:
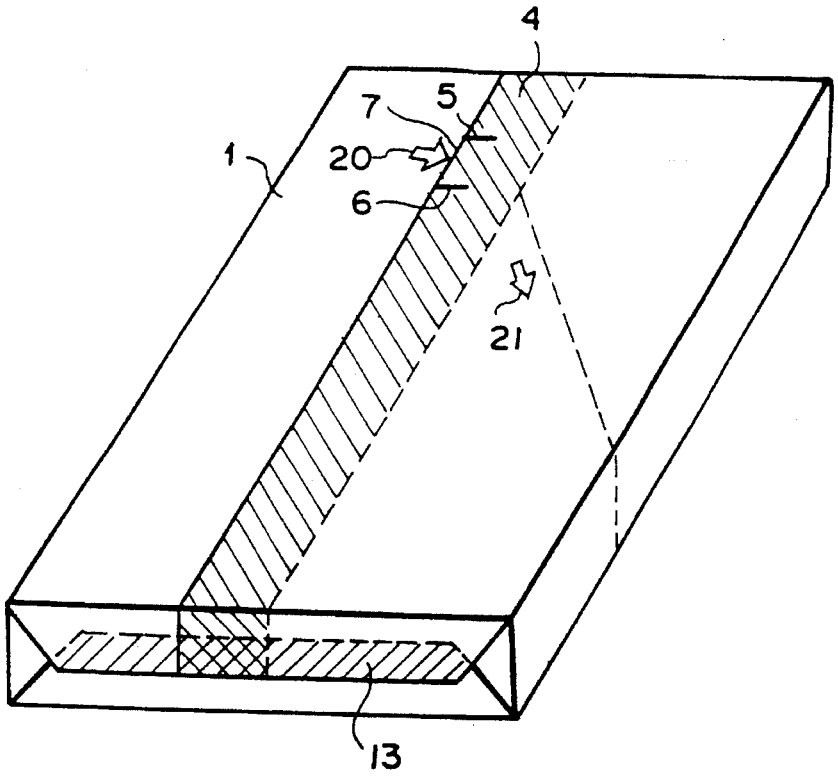
FIG. 17 is a schematic representation showing a wrapped article of the present invention in which an unbonded part and the slits are provided with a mark.

Moreover, to make distinctive the position of the removal tab and a tearing direction, for example, the wrapping film may be provided with arrows 20 and 21 as shown in FIG. 17.

A distance between the slits 5 and 6 cut along the marginal line of the body seal section of the upper overlapping film should be only enough for a finger nail or fingers to pick up the removal tab. Generally, the distance is selected from the range between 5 and 20 mm.

Figure 18:
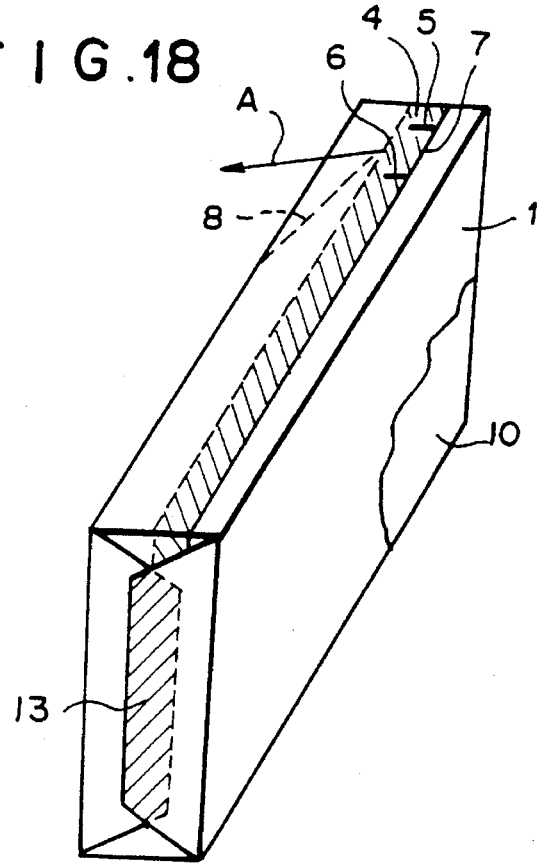
FIG. 18 is a schematic representation showing a wrapped article of the present invention when it is applied to an audio cassette.
Figure 19:
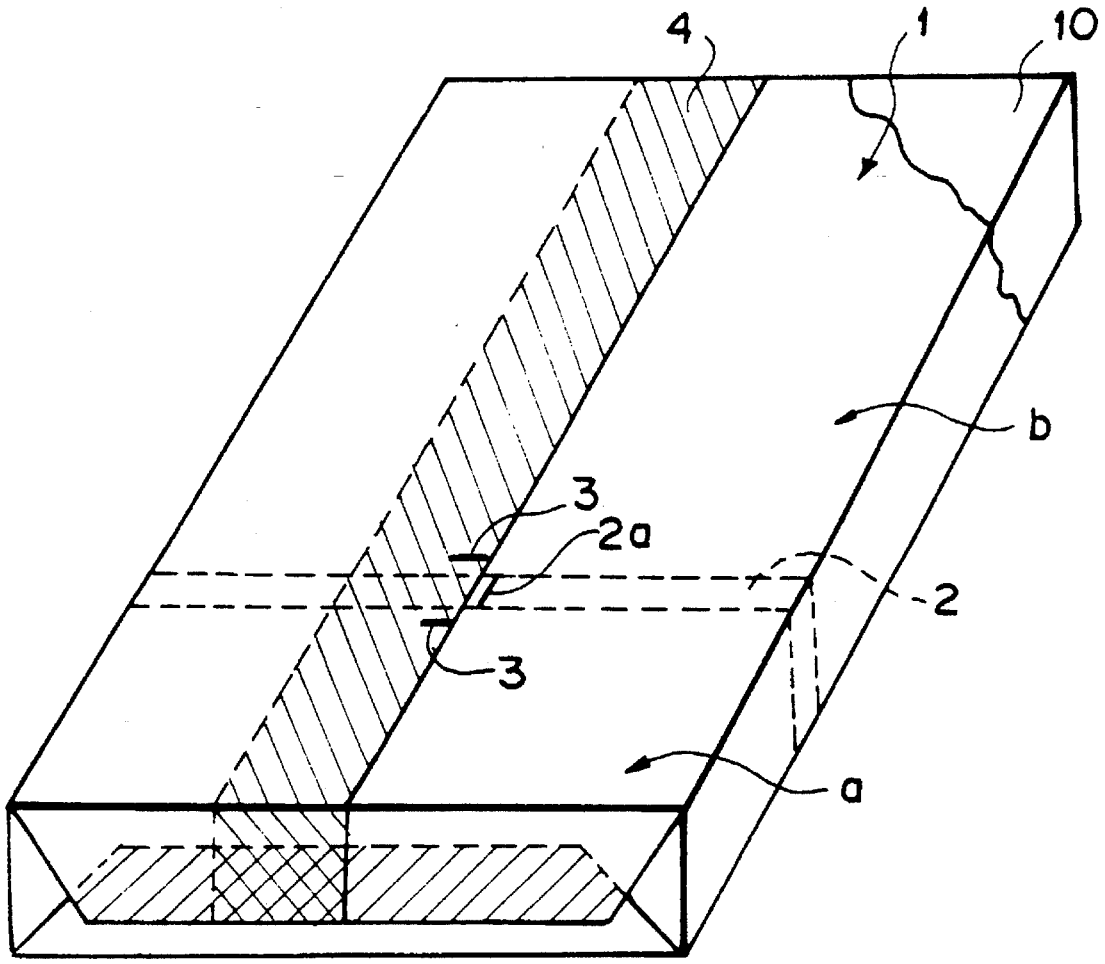
FIG. 19 is a schematic representation showing a conventional wrapped article.

In the previous embodiments, the article to be wrapped is a video cassette, but the wrapped article of this invention can be applied to, for example, an audio cassette as shown in FIG. 18, in which the body seal section 4 is created in a narrower surface of the rectangular-parallelopiped cassette. Also, in the previous embodiment, an audio cassette and a video cassette or the like are used as the wrapped article, but the wrapped article is not limited to them. The wrapped article of this invention can be applied to articles in any shapes such as a sphere, a rectangular parallelopiped, a column, or a circular cone so long as it can be wrapped with a wrapping film.

As mentioned above, according to the wrapped article of the present invention, the unbonded part, the removal tab consisting of two slits and the perforated section are created in the body seal section without the use of a tearing tape, and hence the wrapping film can be widely torn up from this removal tab and the perforated section when the film is opened. Therefore, the wrapping film is not completely separated into pieces while they still remain tightly attached to an article to be wrapped, which is common in opening the film by the use of a conventional tearing tape. Thus, the wrapping film can be peeled off in such a way that the article to be wrapped is easily uncovered by a single opening action. Moreover, the wrapped article of this invention yields several advantages; namely, a step for providing a tearing tape can be omitted from processing steps, and also a tearing tape itself becomes unnecessary, whereby material costs can be reduced.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. A wrapped article including an article to be wrapped whose outer surface is covered with a wrapping film which constitutes an outermost portion of the wrapped article, the wrapping film comprising a body seal section created by making ends of the wrapping film overlap with each other and bonding them together, the improvement comprising:

a removal tab portion made up of two slits that are spaced apart from each other by an interval and cut along the edge of the body seal section of an upper wrapping film in the body seal section; and at least one perforated section or indentation which starts from a point at which the perforated section or indentation and an imaginary continuation from at least one of the two slits of the removal tab cross, and which extends in a direction moving away from the imaginary continuation of the other slit, wherein one of a front and a rear surface of the removal tab portion is printed in ink that differs in coefficient of thermal contraction from the wrapping film.

2. A wrapped article as defined in claim 1, wherein the removal tab is provided with a mark to make clear the removal tab and a peeling direction.

3. A wrapped article as defined in claim 1, further comprising a second perforated section or indentation which starts from a point at which the second perforated section or indentation and the imaginary continuation from the other slit cross, and which extends in a direction moving away from the first perforated section or indentation.

4. A wrapped article as defined in claim 3, wherein the front or rear surface of the removal tab portion is printed in ink that differs in coefficient of thermal contraction from the wrapping film.

5. A wrapped article as defined in claim 3, wherein the removal tab is provided with a mark to make clear the removal tab and a peeling direction.

6. A wrapped article as recited in claim 1, wherein a first one of said slits extends in a direction substantially transverse to a marginal line of the upper wrapping film, and a second one of said slits extends at an oblique angle with respect to said first one of said slits.

7. A wrapped article as recited in claim 6, wherein said at least one perforated section or indentation is collinear with an imaginary continuation from said second one of said slits.

8. A wrapped article as recited in claim 6, comprising two perforated sections or indentations which are collinear, respectively, with the imaginary continuations from said two slits.

9. A wrapped article as recited in claim 1, wherein said at least one perforated section or indentation forms an oblique angle with respect to the imaginary continuation from said at least one of the two slits.

10. A wrapped article as recited in claim 9, comprising an additional perforated section or indentation which forms an oblique angle with respect to the imaginary continuation from the other slit.

11. A wrapped article including an article to be wrapped whose outer surface is covered with a wrapping film which constitutes an outermost portion of the wrapped article, the wrapping film comprising a body seal section created by making ends of the wrapping film overlap with each other and bonding them together, the improvement comprising:

a removal tab portion made up of two slits that are spaced apart from each other by an interval and cut along the edge of the body seal section of an upper wrapping film of the wrapping film in the body seal section; and at least one first perforated section or indentation which starts from a point at which the perforated section or indentation and an imaginary continuation from at least one of the two slits of the removal tab cross, and which extends in a direction moving away from the imaginary continuation of the other slit; and at least one second perforated section or indentation which starts from a point at which the second perforated section or indentation and the imaginary continuation from the other slit cross, and which extends in parallel to the first perforated section or indentation, wherein one of a front and a rear surface of the removal tab portion is printed in ink that differs in coefficient of thermal contraction from the wrapping film.

12. A wrapped article as defined in claim 11 wherein the removal tab is provided with a mark to make clear the removal tab and a peeling direction.

13. A wrapped article as recited in claim 11, wherein said at least one first perforated section or indentation forms an oblique angle with respect to the imaginary continuation from said at least one of the two slits, and wherein said at least one second perforated section or indentation forms an oblique angle with respect to the imaginary continuation from the other slit.

* * * * *